United States Patent [19]

Jeppson

[11] 4,252,459

[45] Feb. 24, 1981

[54] ENERGY CONSERVING PAVING METHOD AND APPARATUS USING MICROWAVE HEATING OF MATERIALS

[75] Inventor: Morris R. Jeppson, Carmel, Calif.

[73] Assignees: Microdry Corporation, San Ramon; Giselle V. Laurmann, Carmel, both of Calif.; Richard R. Blurton; Claire M. Blurton, both of Incline Village, Nev. ; part interest to each

[21] Appl. No.: 920,972

[22] Filed: Jun. 30, 1978

[51] Int. Cl.[3] ..... E01C 7/06

[52] U.S. Cl. ..... 404/77; 404/95

[58] Field of Search ..... 404/77, 75, 95, 90, 404/92, 91; 126/271.1, 275 E; 328/7

[56] References Cited

U.S. PATENT DOCUMENTS

| | | | |
|---|---|---|---|
| 2,159,509 | 5/1939 | Mosel | 404/92 |
| 2,169,406 | 8/1939 | Cost | 404/92 |
| 2,169,987 | 8/1939 | Mosel | 404/75 |
| 2,394,017 | 2/1946 | Seaman | 404/95 |
| 2,898,825 | 8/1959 | Walker | 404/75 X |
| 3,055,280 | 9/1962 | Neville | 404/95 |
| 3,361,042 | 1/1968 | Cutler | 404/90 |
| 3,601,448 | 8/1971 | Stone | 299/14 |
| 3,843,274 | 10/1974 | Gutman | 404/91 |
| 3,874,366 | 4/1975 | Cutler | 404/95 X |
| 4,011,023 | 3/1977 | Cutler | 404/91 |
| 4,124,325 | 11/1978 | Cutler | 404/95 X |

OTHER PUBLICATIONS

"The Journal of Microwave Power", A Publication of, The International Microwave Power Institute of Canade, 9(4) 1974; 7 pages.

"Microwave Heating For Road Maintenance", 3/76 Syracuse University Research Report.

*Primary Examiner*—Nile C. Byers, Jr.

*Attorney, Agent, or Firm*—Phillips, Moore, Weissenberger, Lempio & Majestic

[57] ABSTRACT

Asphaltic concrete constituents (13) or the like deposited in a windrow (14*a*) along a surface (12) to be paved are molded into a preliminary narrow layer (14*b*) of greater height than the final layer (14*d*) of pavement to be formed on the surface and are then heated by directing microwave energy into the preliminary layer. The heated preliminary layer is then spread out to form the final thinner layer of paving material for smoothing and compaction. Molding means (37) for the preliminary layer and microwave heating means (38) may be carried on a vehicle (16) which travels along the windrow. The vehicle may also carry mixing, spreading and compaction means (39, 92, 89) or some or all of these elements may be on a separate paver vehicle. The method and apparatus reduces an unproductive dissipation of energy, which can occur if microwave heating is performed with the paving materials spread out in the relatively thin final layer, by avoiding unnecessarily deep penetration of the microwave energy into the underlying surface that is to be paved. Auxiliary heating means (79), preferably using thermal energy recovered from the exhaust of engines (28) which drive the electrical generators (29) that energize the microwave sources (52), may be used to preheat portions of the surface adjoining the portion overlain by the preliminary layer.

27 Claims, 6 Drawing Figures

ENERGY CONSERVING PAVING METHOD AND APPARATUS USING MICROWAVE HEATING OF MATERIALS

TECHNICAL FIELD

This invention relates to the paving or repaving of surfaces with asphaltic materials or the like and more particularly to a method and apparatus for more efficiently using microwave energy to heat paving materials in place on the surface to be paved.

BACKGROUND OF THE INVENTION

In paving or repaving surfaces with asphaltic concrete or other thermoplastic materials it is a common practice to transport paving constituents to a fixed preparation plant and then hot mix from the plant is trucked to the paving site. Transport costs for such purposes are substantially greater than would be the case if the materials were hauled directly to the paving site and then heated and mixed at the paving site in an economically efficient manner.

Disadvantages of this conventional paving procedure are not limited to the typically high hauling costs. As the hot mix tends to cool while being trucked to the paving site, it is often heated to a higher temperature at the plant than is required during paving operations at the distant work site. Alternately, elaborate hot mix transporting vehicles may be used which continue to heat the material en route to the paving site and which also continue to mix the material since cooling tends to be uneven. Because of cooling which occurs en route to the paving site, different batches of material may arrive at somewhat different temperatures and there may be undesirable temperature differentials within a single batch of materials. This means that process control of temperatures at the paving site is far from ideal and this may adversely affect the quality of the pavement.

It has heretofore been proposed to truck pavement constitutents directly to the work site at which the pavement is to be laid down and to heat and mix the materials at that location using combustion heaters. This has not become a widespread practice except for the patching of very small localized areas of a roadway or the like. It is believed that such a practice has not been widely adopted at least in part because of a lack of economically feasible methods or apparatus for quickly and efficiently heating paving materials at the actual paving site. Some of the transportation costs may be reduced and some of the other adverse factors discussed above may be alleviated by paving with cold mixes, but these often do not provide as high a quality pavement as hot mixes and also tend to constrict flexibility of process control at the paving operation. For example, paving operations with any given batch of cold mix must be accomplished within restrictive time constraints before the emulsification process has proceeded to a critical point.

My copending U.S. patent application Ser. No. 756,365, filed Jan. 3, 1977 and entitled MICROWAVE METHOD AND APPARATUS FOR REPROCESSING PAVEMENTS, discloses methods and apparatus for repaving operations at deteriorated roadways or the like which greatly reduce or even eliminate the cost of transporting paving materials by recycling the old pavement at the site. In the method of my above-identified copending application, deteriorated asphaltic concrete pavement is decomposed in a very rapid and efficient manner by directing microwave energy downwardly into the old pavement. The old pavement constituents are then remixed in place on the roadbed or the like and recompacted to provide a high quality repaved surface.

It has not been recognized in the industry that work site heating of paving materials with microwave energy can also provide very substantial cost reduction in connection with the initial paving of surfaces with new materials or in situations where a layer of additional paving materials is to be applied over old pavement. Apparatus disclosed in my above-identified copending application may be used for this purpose. New or reclaimed paving materials in an unheated condition may be spread out in a layer of the desired thickness on the surface which is to be paved. The apparatus of my copending application may then be traveled along the surface to be paved while heating the layer of material very rapidly and uniformly by directing microwave energy downwardly into the material. The heated materials may then be mixed on the roadbed and then compacted to form the layer of new pavement. Substantial cost economies may be realized by this technique. Costs may be further reduced and energy efficiency may be further enhanced by recovering heat from the exhaust of the engines which drive the generators to power the microwave sources and then using such heat to supplement the microwave heating of the paving materials.

It is desirable to reduce paving costs still further, particularly by further increasing energy efficiency in view of the growing scarcity of energy resources. I have now recognized that a significant unproductive dissipation of energy may occur in the on site heating of paving materials with microwave energy as described above, the reduction of which would still further increase energy efficiency and reduce costs. In particular, I have observed that the desired thickness of a layer of new paving to be applied to a surface is often less than the depth to which the microwave energy penetrates downwardly through the material and into the underlying surface. While some heating of the extreme upper portions of the underlying surface may be desirable to assure good bonding with the new paving, the microwave heating of the deeper portions of the underlying surface is unnecessary and results in an unproductive dissipation of costly microwave energy.

Aside from energy considerations, on site microwave heating of paving materials according to the above-described technique is subject to a further complication in specialized circumstances where a wall, bridge framing or other obstruction adjoins the area to be paved. As broad trapping structures are present at the sides of the microwave energy applicator to prevent an outward broadcasting of microwave energy, the edges of the area are not directly heated by microwave energy.

DISCLOSURE OF INVENTION

The present invention is directed to overcoming one or more of the problems as set forth above.

In one aspect of the present invention, cost economies in the paving of a strip of surface are realized by forming the paving materials into a preliminary layer which extends along the strip of surface and which is of greater height and lesser width than the final layer of pavement to be applied to the surface. The preliminary layer of paving materials is then heated by directing microwave energy downwardly into the preliminary layer. The heated preliminary layer is then spread laterally to form the desired thinner final layer of pavement on the surface. The paving materials may be mixed in place on the surface after initiation of the microwave heating and the microwave heating may be supplemented by other heating means, preferably using thermal energy recovered from the exhaust of the engines which drive the generators that power the microwave sources. Auxiliary heat may also be applied to the portions of the strip of surface that adjoin the portion heated by the microwave energy so that good bonding will result throughout the width of the strip of surface.

In another aspect of the invention, apparatus for practicing the above-described method may include a paving materials processing vehicle for traveling along the strip of surface to be paved which carries microwave applicator means for directing microwave energy downwardly into paving materials situated on the surface and which also carries windrow shaping means for forming the paving materials into a preliminary layer of greater height and lesser width than the final desired layer of paving for passage underneath the microwave applicator means. The vehicle may be followed by a conventional paver which spreads the heated paving materials laterally to form the thinner final layer and smoothes and compacts the spread materials or, alternately, spreading and compaction means may be carried on the heating vehicle itself. The vehicle may also carry means for mixing additional constituents into the windrow material in conjunction with the above-described operations.

The invention realizes sizable cost economies in several respects. Paving materials may be transported directly to the paving site instead of being temporarily routed to a distant fixed processing plant and may, if desired, be brought to the paving site in an unheated and/or unmixed condition. Owing to the temporary formation of the paving materials into a preliminary layer which is higher but narrower than the final layer of pavement, a very large proportion of the microwave energy is productively utilized in heating the material rather than in being dissipated by penetration to an unnecessary depth into the underlying surface.

Moreover, more precise and optimum control of process conditions during the paving operations can be realized. For example, the paving materials need not be overheated in anticipation that some probably uneven cooling will occur during transport to the paving site as is the case with the commonly used paving methods. The capability for more controlled uniform heating just prior to laying of the pavement may also enable the use of more optimized mix formulations since it is not necessary to allow for variable and uneven cooling and since there are less rigid time constraints in the handling of the material. An additional advantage of the present invention, in situations where the problem is encountered, is that the presence of broad microwave energy trapping structures along the sides of the microwave applicator means does not interfere with paving of the edges of an area bounded by a wall or other obstruction. As the applicator means heats the relatively narrow preliminary layer of materials, it need not span the entire width of the area to be paved.

The invention, together with further objects and advantages thereof, will best be understood by reference to the following description of preferred embodiments.

BEST MODES FOR PRACTICING THE INVENTION

Figure 1:
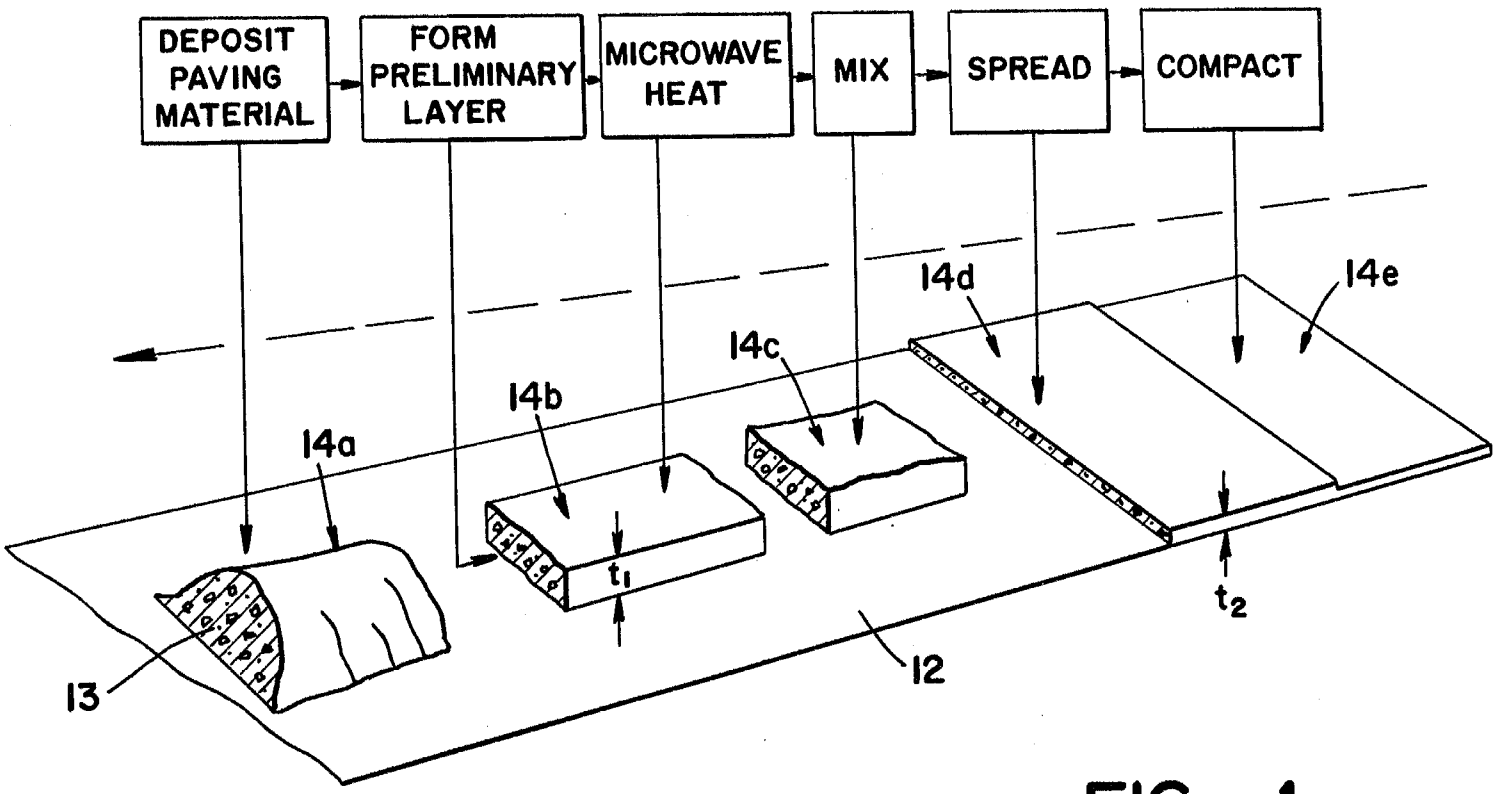
FIG. 1 is a diagrammatic illustration of suitable steps for paving a surface with asphaltic concrete or the like utilizing work site heating of paving materials with microwave energy.

Referring initially to FIG. 1, the method of the invention is applicable to the paving of surfaces 12, such as roadways, bridge decks, aircraft runways or the like, which have not been previously paved and also to surfaces formed by old pavement to which an overlay of additional pavement is to be applied. The method will be described primarily with reference to paving with asphaltic concrete for purposes of example, but it is also applicable to paving with other materials of the type which are applied to a surface in a loose, non-solidified condition and which are compacted while in a heated state.

In the practice of the method, paving materials 13 are initially deposited in a windrow **14*a* extending along the strip of surface 12 which is to be paved. The materials deposited in the windrow 14*a* need not necessarily include all of the final constituents of the pavement, as other constituents may be added in during the practice of the method as will hereinafter be discussed in more detail. For example, windrow 14*a* may contain only the rock aggregate portion of asphaltic pavement, the asphaltic binder being added in in conjunction with mixing operations to be hereinafter described. The windrow 14*a*** may also be formed of materials which cannot be used directly by conventional techniques such as, for example, chunks of old asphaltic concrete recovered from a dump site.

To prepare the materials 13 for rapid efficient on-site heating by microwave energy, the windrow **14*a* is shaped or molded into a preliminary layer 14*b* which is of greater height but lesser width than the final layer 14*e* of paving material to be distributed on the surface 12. In the present example the preliminary layer 14*b* is formed along the centerline of the strip of surface 12** but it may also be formed elsewhere, such as along one side of the surface to be paved.

The height or vertical thickness t1 of preliminary layer **14*b* is selected with reference to the depth to which the microwave energy penetrates through the particular material 13 and into the underlying surface 12. This depth is somewhat variable depending on the dielectric characteristics and volumetric density of the material forming the preliminary layer 14*b* and is also somewhat dependent on the frequency of the microwave energy. While there is not a sharp cut-off point, microwave energy at a frequency of 915 MHz, for example, typically penetrates about 10 to 15 centimeters into asphaltic concrete before being attenuated to an intensity level at which heating of the material ceases to be particularly significant. This penetration depth is usually substantially greater than the vertical height or thickness t2 of the final layer of paving materials 14d which is to be applied to the surface 12 and it is for this reason that energy savings are realized by heating the material while it is formed into the preliminary layer 14b of greater height than the final layer 14d. Unnecessarily deep heating of the underlying surface 12 is avoided. It is usually desirable that the very uppermost region of the surface 12 be heated prior to the compaction of the paving materials to assure good bonding. Thus, under some conditions the height t1 of the preliminary layer 14b is selected to allow penetration of significant levels of microwave energy completely through the preliminary layer and a limited additional penetration into the extreme uppermost portion of surface 12. In some instances, the thickness t1 of the preliminary layer 14b may be made somewhat greater than the effective penetration depth of the microwave energy since the lower portion of the preliminary layer and the uppermost region of the underlying surface 12** may both be adequately heated by heat transfer from the region heated directly by the microwave energy.

To provide for uniform heating throughout the volume of the materials, the preliminary layer 14b may be formed to be of substantially uniform thickness or height t1.

With the vertical thickness t1 of the preliminary layer 14b determined as described above and since the volume of the layer per unit length is determined by the amount of paving material needed to form the final layer 14d across the full width of the strip of surface 12, the lateral width of the preliminary layer is also effectively determined by the above discussed considerations. It should be noted that this lateral width is necessarily less than the width of the thinner final layer 14d in proportion to the differences in the vertical thickness of the two layers.

Heating of the preliminary layer 14b in a very rapid and uniform manner is then accomplished by directing microwave energy downwardly into the preliminary layer 14b from above. With the thickness t1 of the preliminary layer 14b selected as previously described, at least most of the microwave energy is absorbed in the paving materials to contribute heat to such materials rather than being dissipated in heating the underlying surface 12 to an unnecessary depth.

As heating of the surface 12, either by direct microwave heating or by heat transfer from the overlying paving materials, tends to be confined to the limited area underlying the preliminary layer 14b, auxiliary heating may be used to heat the adjoining side portions of the surface 12 which do not underlie the preliminary layer. While combustion heaters or infrared heaters may be used for this purpose, it is usually preferable to use thermal energy recovered from the exhaust gases of the engine which drives the generators that energize the microwave sources, thereby further increasing the energy efficiency of the method as a whole, suitable apparatus for accomplishing this step being hereinafter described. Heat energy from the engine exhaust may also be used to supplement the microwave heating of the paving materials.

Following microwave heating of the preliminary layer 14b or concurrently with the heating, the preliminary layer may be mixed as indicated at 14c to assure a uniform temperature throughout the material and to assure a uniform distribution of components of the paving materials in the mix. If the windrow 14a initially contained less than all of the desired constituents for the pavement, the additional materials may be added in prior to or during the mixing step. For example, in some instances, the initial windrow 14a may consist only of rock aggregates, in which case the asphaltic binder and such other additives as may be desired may be added prior to or during the mixing step. As will hereinafter be discussed in more detail, multiple, alternated stages of microwave heating and mixing may be employed.

Following the above-described steps, the paving materials may then be spread out to the full width of the surface 12 which is to be paved to form the thinner final layer 14d of heated paving materials. The final layer 14d may then be screeded or otherwise smoothed and compacted to form the desired pavement 14e.

While some or all of the steps of the process described above may be performed on a batch basis using equipment which temporarily remains stationary at the portion of the surface 12 which is to be paved with that batch of material, it is usually more efficient to perform some or all of the steps continuously while traveling slowly along the strip of surface 12 which is to be paved.

Figure 2:
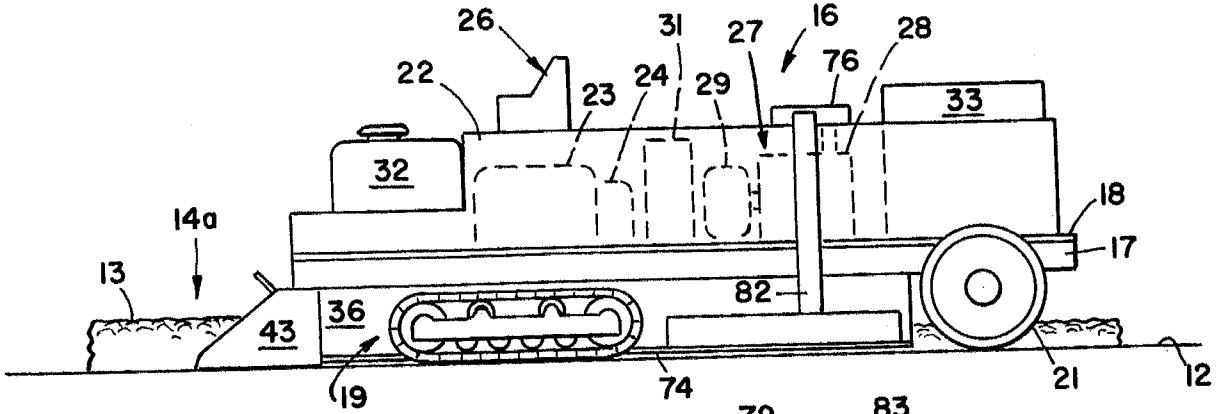
FIG. 2 is a side elevation view of a paving materials processing vehicle suitable for use in the practice of the method of FIG. 1.
Figure 3:
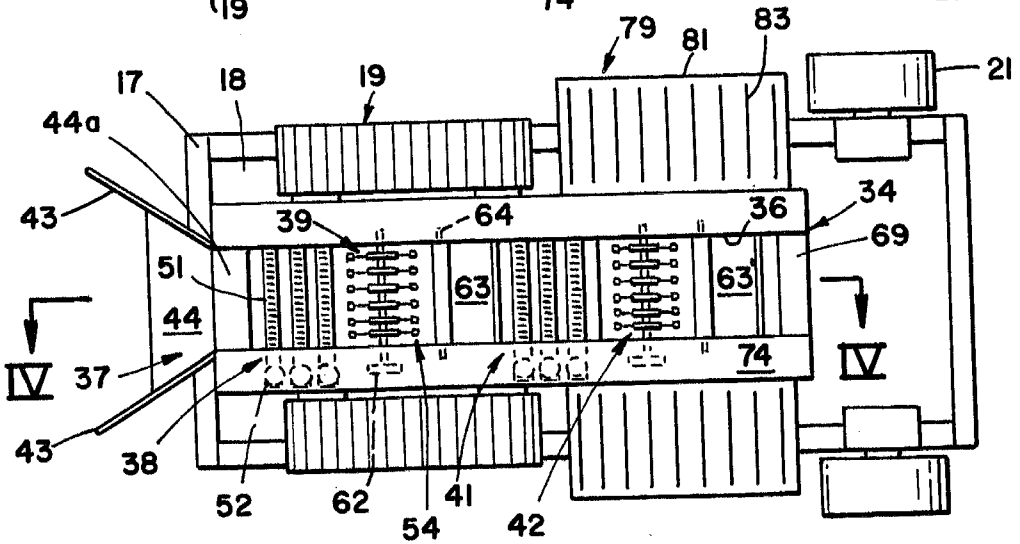
FIG. 3 is a view of the underside of the vehicle of FIG. 2.
Figure 4:
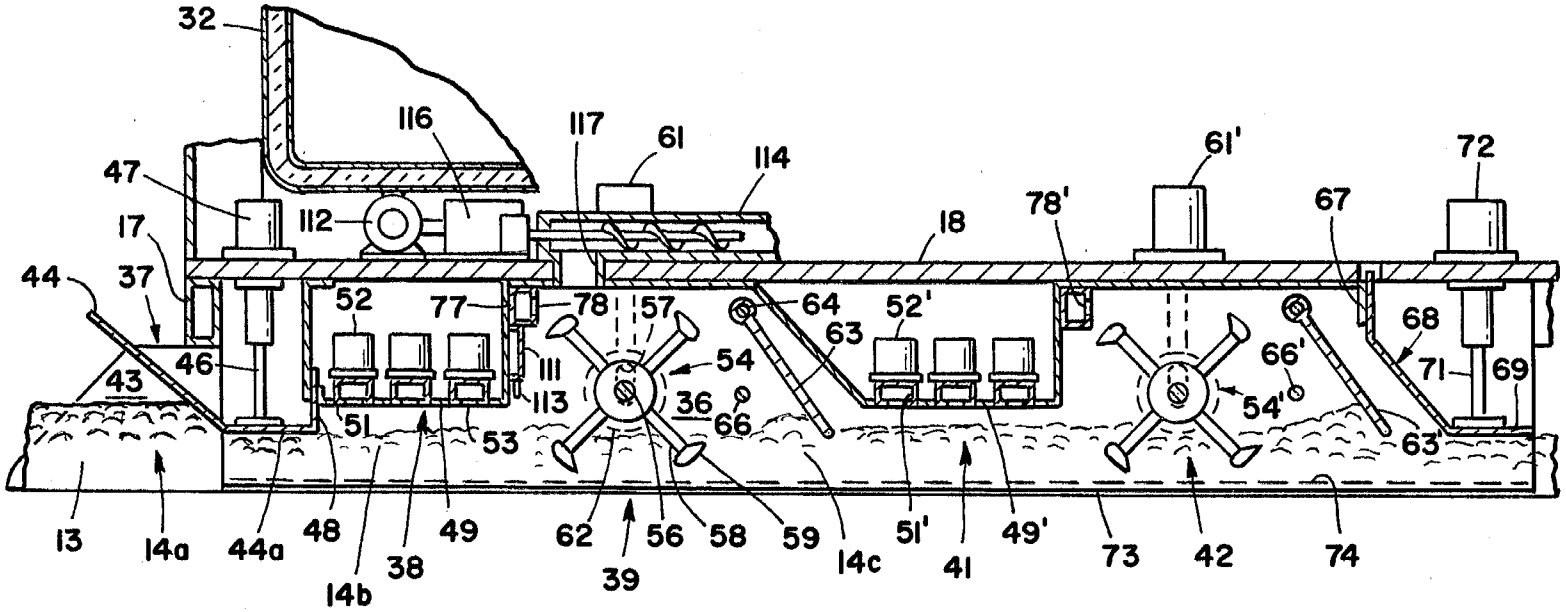
FIG. 4 is a section view of a portion of the vehicle of FIGS. 2 and 3 taken along line IV—IV of FIG. 3.

FIGS. 2, 3, and 4 illustrate a first embodiment of a paving materials processing vehicle 16 suitable for the practice of the above-described method.

Referring initially to FIGS. 2 and 3 in conjunction, the materials processing vehicle 16 may have a rectangular frame 17 and platform 18 which are supported at the forward end by crawler track assemblies 19 and at the back end by large road wheels 21. A housing 22 carried on platform 18 encloses an engine which drives the crawler track assemblies 19 and which also drives a hydraulic pump 24 for supplying pressurized working fluid to the several hydraulic actuators and motors to be hereinafter described. An operator's station 26 is situated above housing 22. A pair of motor-generator sets 27, each including a fuel consuming motor 28 driving an electrical generator 29 are carried on platform 18 to provide electrical energy to microwave source power supplies 31. The above-described components such as the track assemblies 19, engine 23, pump 24, motor generator sets 27 and microwave power supplies 31 may be of known detailed constructions.

To facilitate use of the paving materials processing vehicle 16 in situations where additional constituents are to be added into the paving materials that are deposited on the surface 12 in windrow 14a, one or more constitutent receptacles may also be carried on platform 18. In this example such receptacles include a thermally insulated tank 32 for carrying heated asphalt or other liquid materials and a bin 33 for carrying supplementary aggregates or other solid materials.

As the vehicle 16 travels along the surface 12, the paving materials 13 of the windrow 14a are received in an inverted channel structure 34 secured to the underside of the vehicle and within which the materials are shaped into a preliminary layer and heated and mixed while remaining on the surface 12. Channel structure 34 has vertical side walls 36 spaced apart to define the lateral width of the preliminary layer 14b of paving material which width, as hereinbefore discussed, is less than the width of the final layer of pavement materials to be applied to the surface 12. Shaping means 37 for intercepting the windrow 14a and for forming the paving materials 13 into the preliminary layer are disposed at the forward end of the channel structure 34 and are followed in sequence by a first microwave applicator means 38 and a first mixing means 39. While the vehicle 16 may carry only the microwave heating means with the mixing being accomplished by other apparatus which follows the vehicle, it is usually advantageous to provide for both steps on the single vehicle. Multiple stages of each function may be preferable and in the present example the first mixing means 39 is followed by a second microwave applicator means 41 and a second mixing means 42. Additional stages of microwave heating and mixing may be included in some cases.

The shaping means 37 includes a pair of side panels 43 which diverge outwardly from the forward end of channel structure 34 to intercept the material of windrow 14*a* and to compact such materials laterally to the predetermined width of the preliminary layer as the vehicle moves along the windrow. Referring now to FIG. 4 in conjunction with FIG. 3, the shaping means 37 further includes a top panel 44 which slants upwards from the forward end of the channel structure 34 between side panels 43 to depress portions of the paving material 14*a* which may extend above the desired height of the preliminary layer 14*b*. The lower rear portion 44*a* of top panel 44 extends horizontally backward for a short distance, between the side walls 36 of the channel structure 34, to cause the preliminary layer 14*b* to have the desired predetermined height in accordance with the criteria previously discussed. The rear portion 44*a* of top panel 44 in conjunction with the adjacent portion of side walls 36, all of which are formed of electrically conductive material, also function to block the release of microwave energy out of the forward end of the channel structure as such energy will not pass through an electrically conductive surface nor through a lengthy volume of microwave absorbent dielectric material. As the passage below top panel 44 is, during operation, filled with a lengthy volume of the highly microwave absorbent paving material, energy attempting to propagate forwardly through the passage is gradually attenuated and does not escape at significant power levels.

To provide for selective adjustment of the height of the preliminary layer 14*b* of paving materials, top panel 44 of the shaping means may be supported by the downwardly extending adjustable rods 46 of vertically oriented hydraulic actuators 47 mounted on platform 18.

The first microwave applicator means 38 may be situated between side walls 36 immediately behind an upturned end 48 of molding means top panel 44. A horizontal cross panel 49 extends between side walls 36 at a level a small distance above the top of the preliminary layer 14*b* of paving materials and has a forward edge abutting the upturned back end 48 of top panel 44. Spaced apart waveguides 51, of which there are three in this example, are supported on cross panel 49 and extend transversely between the side walls 36. The waveguides 51 are disposed at conforming slots in the cross panel 49 so that the lower portion of each waveguide is exposed to the region beneath the cross panel. Each such waveguide 51 is excited by an associated magnetron tube 52 or other suitable microwave energy source which may be supported directly on one end of the waveguide. The lower wall of each of the waveguides 51 has one or more openings, which are a series of small spaced-apart parallel slits 53 in this example, for emitting microwave energy downwardly in a substantially uniform manner along the length of the waveguide. The waveguides 51 may, for example, be of the so-called leaky waveguide form, disclosed in my prior U.S. Pat. No. 3,263,052.

Cross panel 49, which is formed of electrically conductive material, as angled upwardly behind waveguides 51 and then again extends horizontally just under platform 18 to form the roof of the first mixing means 39. Mixing means 39 may include any of various mechanisms suitable for stirring, raking or otherwise intermixing the constituents of the paving material and in the present example a powered rotary tiller 54 is employed. Tiller 54 may include a rotary cross shaft 56 the opposite ends of which extend through vertical slots 57 in side walls 36. Arms 58, each having a stirring head 59 at the outer end, extend radially from shaft 56 and are proportioned so that with shaft 56 at the lowermost position within slots 57, the stirring heads 59 just clear the underlying surface 12. To provide for selective raising of the tiller 54, the ends of shaft 56, outside side walls 36, are coupled to the lower ends of the rods of vertically oriented fluid actuators 61 mounted on platform 18, the coupling of the shaft to the rod of the fluid actuator at one end of the shaft being a rotary fluid motor 62 secured to the lower end of the actuator rod which turns the shaft to drive the tiller. The tiller 54 is preferably turned in a counter-clockwise direction as viewed in FIG. 4 so that any paving material which may be impelled upward is directed towards a drag blade 63 situated between side walls 36 behind the tiller. Drag blade 63 is supported at the upper edge by a pivot shaft 64 which enables the blade to swing backward and upward from a vertical position to the extent necessary to allow the paving materials to pass underneath the blade. Forward pivoting of the drag blade 63 is limited by a cross rod 66 situated below pivot shaft 64 to prevent the blade from swinging into the orbit of tiller heads 59.

Drag blade 63 intercepts material which may be thrown backward and upward by the motion of the rotary tiller 54. This aids in the mixing in that lumped or chunked portions of such material tend to be disintegrated by the impact on the blade. The drag blade 63 further serves to regrade the paving materials to reestablish a uniform height for the layer of materials.

Behind the drag blade pivot shaft 64, cross panel 49 slants downward to limit backward pivoting of the drag blade and then again extends horizontally to define the cross panel section 49′ of the second microwave applicator means 41. Second microwave applicator means 41 may be similar to the first such means 38 and thus again may consist of three transversely extending leaky waveguides 51′, excited by magnetron tubes 52′ and mounted at conforming slots in the cross panel. Similarly, the second mixing means 42 including a powered rotary tiller 54′ and drag blade 63′ may be similar in construction to the first mixing means 39 as previously described.

Behind the drag blade 63′ of the second mixing means 42, cross panel 49 has a short downwardly extending back end section 67 against which the forward end of a vertically adjustable exit chamber panel 68 is abutted. Exit chamber panel 68 slopes downward and backward behind drag blades 63′ and has a horizontal back portion 69 which extends between side walls 36. Exit panel 68 is supported by connection to the rods 71 of vertically oriented fluid actuators 72 mounted on platform 18. The back portion 69 of the exit panel may thus be controllably raised and lowered to adjust to the height of the layer of material over which the panel passes as the processing vehicle travels along the surface 12. This blocks escape of microwave energy from the back end of channel structure 34 since in operation the region between side walls 36 and below portion 69 of the exit panel is substantially filled with the microwave absorbent paving material.

Where a small gap 73 or clearance between the bottom edges of side walls 36 and the underlying surface 12 is needed to avoid abrasion of the side walls by irregularities in the surface, care must also be taken to assure that significant amounts of microwave energy are not emitted sidewardly from the apparatus at the resulting gap 73. Microwave emission at the gap 73 is suppressed to a considerable extent by the volume of microwave absorbent paving materials between the lower areas of the side walls, but to further suppress microwave emission, the extreme lower portion 74 of each side wall 36 may be angled to extend laterally outward from the bottom of the channel structure 34 for a distance of at least several centimeters. The outwardly angled lower portions 74 of the side walls then function as gap traps of the form described in my hereinbefore identified copending U.S. patent application Ser. No. 756,365. In particular, microwave energy attempting to propagate outwardly from the sides of the channel structure 34 in the gap 73 between the electrically conductive material of the side wall section 74 and the underlying microwave absorbent surface 12 is rapidly attenuated. The portion of such energy that is propagating downward penetrates the surface 12 and is absorbed. The portion of the energy which may be propagating upwardly is reflected by the electrically conductive material of side wall portions 74 so that it also becomes largely directed downward into the absorbent underlying surface 12. Thus, there is a progressive decrease of microwave energy intensity in the outward direction within gap 73 and by making the side wall portions 74 of sufficient lateral extent, the energy is attenuated to a negligible level at the outer edge of the gap.

Other forms of microwave traps for the gap between the underside of the moving vehicle and the underlying surface, of any of the several types described in my above-identified copending application Ser. No. 756,365 may also be employed in conjunction with or in place of the gap trap defined by the side wall portions 74.

As around 70% of the energy content of fuels consumed by engines is typically wasted in the form of exhaust heat, substantial further energy efficiency in the practice of the invention may be realized by recovering and utilizing exhaust gas energy from the motors 28 which drive the generators 29 that energize the microwave sources 52 or from the vehicle drive engine 23 or both. An exhaust gas manifold 76 is provided on housing 22 to collect the hot exhaust gases from such sources.

Referring again to FIG. 4, a portion of the heat energy of the engine exhaust gases may be used to supplement the microwave heating of the paving materials 13. A hot gas conduit 77 having a series of gas emission openings 78 extends between side walls 36 at each mixing section 39 and 42 and is communicated with the exhaust gas collection manifold 22 to release the hot exhaust gases into the channel structure 34. In instances where the direct release of engine exhaust gas into the environment is undesirable, a heat exchanger may be used between the engine exhaust system and conduits 77.

To provide for the addition of hot liquid asphalt or other fluid additives into the paving materials 13, another conduit 111 extends transversely between side walls 36 within the first mixing means 39 region of the channel structure 34. Liquid from tank 32 is delivered to conduit 111 by a pump 112 and a series of spray nozzles 113 direct the liquid downward into the paving materials in front of tiller 54. Water and/or other emulsifying additives may be injected through spray nozzles 113 to produce relatively low temperature emulsion asphalt mixes. To provide for the addition of supplementary aggregate or other solid materials, a series of screw conveyors 114 are each driven by a rotary fluid motor 116 and have an outlet 117 penetrating through platform 18 and cross panel 49 at the first mixing means 39 portion of channel structure 34. The conveyors 114 carry materials from bin 33 (FIG. 2) forward and release such materials through outlets 117.

Referring again to FIGS. 2 and 3 in conjunction, it has been pointed out that a better, more uniform bonding of the paving materials to the surface 12 may be accomplished by heating the surface 12 prior to spreading the final layer of paving materials. That portion of the surface 12 over which the channel structure 34 passes may be heated directly by microwave energy or indirectly by heat transfer from the heated paving materials or both. Auxiliary heating means 79 are carried on vehicle 16 to heat the adjoining portions of the strip 12 as the vehicle travels along the surface. While the auxiliary heating means 79 may be of more conventional form, such as gas combustion heaters or infrared heaters, the objective of energy efficiency is better realized if another portion of the engine exhaust gases collected in manifold 76 are used for this purpose. In the present example, one of a pair of rectangular gas emission housings 81 is secured to each side wall 36 of the channel structure 34 and extends outward from the side wall to the edge of the strip of surface 12 which is to be paved. Each such gas emission housing 81 is communicated with gas collection manifold 76 by a conduit 82 and each has a series of transverse gas emission slits 83 at the underside to direct hot exhaust gases downwardly to the underlying areas of surface 12 as the vehicle travels along the surface.

Figure 5:
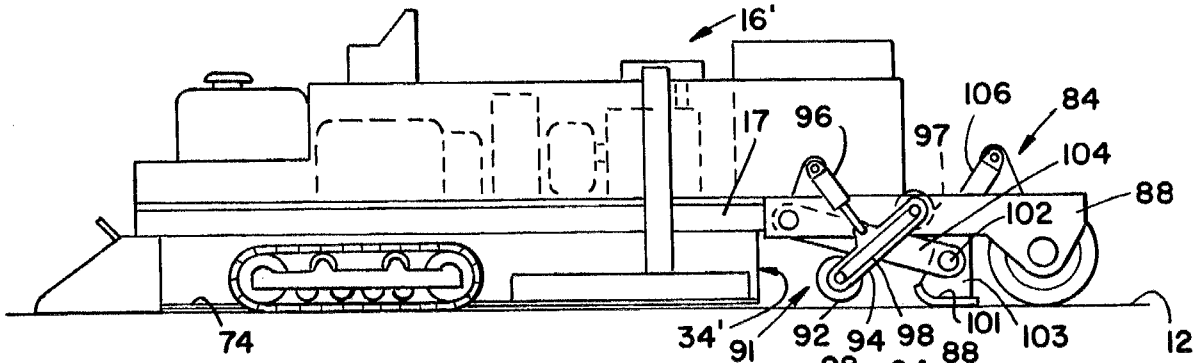
FIG. 5 is a side elevation view of a modification of the vehicle of FIGS. 2 to 4 enabling the vehicles to perform additional paving operations.
Figure 6:
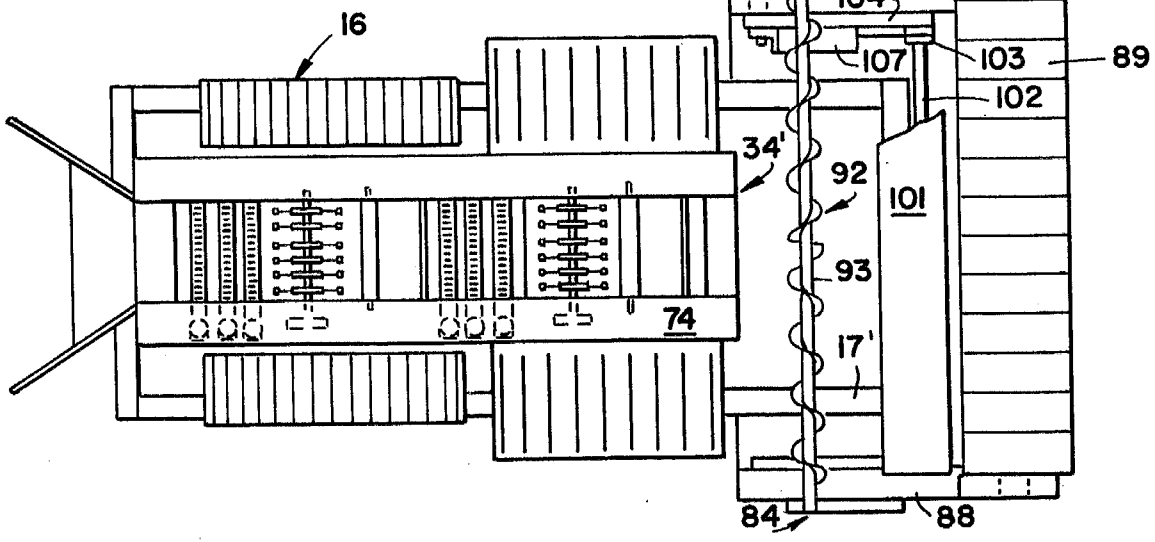
FIG. 6 is a view of the underside of the modified vehicle of FIG. 5.

A paver apparatus of the known commercially available form may be traveled along surface 12 behind the above-described paving materials processing vehicle 16 in order to spread, grade and compact the heated and mixed paving materials which remain in a windrow on the surface 12 after passage of the paving materials processing vehicle 16, but in some operations it may be preferable that the spreading and compaction functions be integrated into the materials processing vehicle 16 itself. A suitable modification of the paving materials processing vehicle 16' for this purpose is depicted in FIGS. 5 and 6.

The modified vehicle 16' as adapted for performing the entire paving method may be similar to the previously described materials processing vehicle except insofar as the road wheels which support the back end of the previously described vehicle are removed and a paver attachment 84 is secured to the back end of the vehicle frame 17.

Paver attachment 84 has a supplementary frame 86 which is broader than the vehicle frame 17 to which it attaches in order to span the entire width of the strip of surface 12 which is to be paved. An axle shaft 87 extending between the back ends of side members 88 of the supplementary frame 86 journals compactor wheels 89 which jointly form a continuous cylindrical compactor to compact the final layer of paving materials and which also supports the back end of the vehicle.

In order to spread the heated and mixed paving materials laterally to cover the full width of the surface 12 to be paved, spreader means 91 are situated below supplementary frame 86 in back of the channel structure 34' of the vehicle. Spreader means 91 in this example is an auger 92 which spirals in opposite directions at each side of the center point of the auger shaft 93 so that as the shaft rotates intercepted material which is to the right of the center line of the vehicle is carried further to the right while intercepted material to the left of the vehicle center line is carried further to the left. Auger shaft 93 is journalled at each outer end to the lower end of one of a pair of pivoting support arms 94 which extends backward and upward and are in turn pivoted to the side members 88 of the supplemental frame. One of a pair of fluid actuators 96 is coupled between each support arm 94 and the adjacent supplmentary frame side member 88 to enable raising and lowering of auger 92 relative to surface 12 in order to select the thickness of the final layer of paving materials. The auger 92 is driven by a hydraulic motor 97, secured to one frame member 88, through a drive chain 98 engaging a sprocket gear 99 at one end of the auger shaft 93.

To smooth and pre-compact the final layer of paving material after it is spread by auger 92, a screed 101 is disposed between the auger and the compactor wheels 89. Support brackets 103 which extends upwardly from screed 101 are pivotably coupled to the back end of a pair of drag arms 104, by a transverse shaft 102. Each drag arm 104 is pivoted at the forward end to a separate one of the supplementary frame side members 86. To enable the elevation of the screed 101 to be selectively adjusted, one of a pair of fluid actuators 106 is coupled between each side member 86 and shaft 102. To enable the inclination or angle of attack of the undersurface of the screed 101 to be selectively adjusted, one of another pair of fluid actuators 107 is coupled between each drag arm 104 and the upper end of one of the screed brackets 103.

INDUSTRIAL APPLICABILITY

In the operation of a paving materials processing vehicle 16 of the form depicted in FIGS. 2 to 4, the paving materials 13 are initially deposited in the windrow 14*a* extending along the strip of surface 12 which is to be paved. The amount of material deposited per unit length of the windrow corresponds to the desired volume per unit length of the final layer 13*d* of paving material which is to be applied to the entire width of the surface minus any volumetric increase which may result from the adding in of additional constituents during the processing operations. The paving materials vehicle 16 is then driven along the surface 12 in a path which causes the shaping means side panels 43 to intercept the windrow 14*a* and, in conjunction with top panel 44, to form the materials into the preliminary layer 14*b* of greater thickness but lesser width than the final layer 14*d*.

As the first microwave applicator means 38 passes over the preliminary layer 14*b*, microwave energy is radiated downward into the materials where it is absorbed by dielectric interaction and converted to heat. The upper surface region of the preliminary layer 14*b*, which tends to be less strongly heated by the microwave energy, receives additional heat from the hot engine exhaust gases which are released into the channel structure 34 of the vehicle. Subsequently, the first mixing means 39 passes over the paving material at which stage the first rotary tiller 54 stirs the materials to assure uniform mixing and a uniform temperature distribution. Depending on the nature of the paving materials initially deposited in the windrow 14*a*, additional constituents may be added into the material in conjunction with the mixing action at the first rotary tiller 54. For example, if the windrow is initially composed only of rock aggregate or if it is a mix deficient in asphalt content, pump 112 is operated to spray additional asphalt binder or other desired liquid constituents into the paving materials at nozzles 113. If additional aggregate or other solid constituents are required, motors 113 are operated to cause screw conveyors 114 to deliver such materials from bin 33 to the preliminary layer 14*b* at the region of the first mixing means 39.

The paving materials are then further heated by passage of the second microwave applicator means 41 over the materials and are further mixed by the second mixing means 42.

Passage of the vehicle 16 along the windrow also heats the uppermost part of the underlying surface 12 which is beneath the windrow. Concurrently with this heating of the central portion of the strip of surface to be paved, the adjoining side portions of the surface are also heated by the auxiliary heating means 79, which directs hot engine exhaust gases to the side portions of the surface.

Thus, as the vehicle 16 travels along the surface 12 which is to be paved, a windrow of uniformly heated and thoroughly mixed paving material is left behind along a central strip of surface 12 and the uppermost region of the surface itself is also heated across the entire width of the surface. The vehicle 16 may then be followed by a conventional paver of the kind having a conveyor which picks up the hot mix of the windrow, spreads it laterally and grades and compacts the material to form the final layer of pavement.

Operation of the modified paving materials processing vehicle 16' of FIGS. 5 and 6 may be essentially similar to that described above except that the vehicle 16' also performs the final operations which require a separate paver apparatus when the previous embodiment is used. In particular, the windrow of hot mix paving materials which is left behind on the surface 12 as the channel structure 34' of the vehicle 16' travels along the surface 12, is intercepted and spread by auger 92. By operation of fluid actuators 96. auger 92 is adjusted to be spaced above the surface 12 a distance corresponding to the desired thickness of the final layer of pavement materials to be applied to the surface. Paving material of the windrow situated above the lower edge of the auger 92 is carried sidewardly in both directions and thereby distributed evenly in the desired thin final layer. Screed 101 then travels over the material effecting a smoothing, grading and pre-compaction of the materials. Compactor wheel assembly 89 then passes over the final layer to complete the compaction process, leaving behind the desired paved surface.

Other aspects, objects and advantages of this invention can be obtained from a study of the drawings, the disclosure and the appended claims.

What is claimed is:

1. In a method for paving a surface with paving materials which require heating and in which microwave energy is utilized to produce heat internally within said materials, the steps comprising:

reducing energy wastage from unnecessarily deep generation of heat by temporarily forming said materials into a preliminary layer on a portion of said surface which preliminary layer is of less width and greater height than the final layer of paving materials to be formed on said surface, including fixing said height of said preliminary layer to control the depth of penetration of said microwave energy relative to said surface, heating said paving materials by directing microwave energy downwardly into said preliminary layer while preventing the escape of said microwave energy in upward and outward directions, and spreading the microwave energy heated materials of said preliminary layer to form said final layer of paving materials on said surface.

2. The method of claim 1 comprising the further step of mixing said paving materials of said preliminary layer following initiation of said microwave energy heating thereof and prior to said spreading thereof.

3. The method of claim 2 further comprising repetitively heating said paving materials of said preliminary layer with microwave energy and repetitively mixing said paving materials of said preliminary layer, periods of said mixing being alternated with periods of said microwave heating.

4. The method of claim 2 wherein said preliminary layer is initially formed of less than all of the constituents of the pavement and comprising the further step of adding additional pavement constituents to said preliminary layer prior to completion of said mixing thereof.

5. The method of claim 2 comprising the further steps of spraying liquid emulsifier into said materials prior to completion of said mixing thereof and limiting said heating of said materials by microwave energy to temperatures required for promoting emulsification.

6. The method of claim 1 wherein said paving materials are initially deposited in a windrow extending along said surface and wherein at least said step of forming said paving materials into a preliminary layer and said step of heating said paving materials by directing microwave energy into said preliminary layer are performed while traveling along said surface.

7. The method of claim 6 comprising the further step of heating the sideward portions of said surface which are adjacent to the portion thereof overlain by said preliminary layer substantially concurrently with said microwave heating of said preliminary layer.

8. The method of claim 1 comprising the further step of directing hot gas to the surface of said preliminary layer during said microwave heating thereof.

9. A method for paving a strip of surface with paving materials which require heating in which microwave energy is used to generate heat internally within said materials, comprising:

depositing said materials in a windrow extending along said strip of surface, forming successive portions of said materials into a preliminary layer of uniform thickness while traveling along said windrow including reducing energy wastage from unnecessarily deep generation of heat by forming said preliminary layer to be of lesser width and greater thickness than the final layer of paving materials to be formed on said strip of surface, including fixing said height of said preliminary layer to control the depth of penetration of said microwave energy relative to said surface, heating said paving materials by microwave irradiation of said preliminary layer while traveling along said strip of surface and while suppressing the escape of microwave energy in upward and outward directions, mixing the microwave heated materials of said preliminary layer on said surface while traveling therealong, spreading the heated and mixed materials of said preliminary layer laterally while traveling along said strip of surface to form said final layer of paving materials thereon, and compacting said final layer of materials on said surface while said materials are still in a heated condition.

10. The method of claim 9 comprising the further step of directing hot gas to the areas of said strip of surface which are situated sidewardly from said preliminary layer of materials while traveling along said surface and prior to said spreading of said materials of said preliminary layer.

11. The method of claim 9 wherein the microwave energy for heating said preliminary layer is produced from electrical energy from a generator driven by a fuel consuming engine and comprising the further step of utilizing heat derived from the exhaust gas of said engine to supplement the microwave heating of said preliminary layer.

12. The method of claim 11 comprising the further step of using a portion of said heat derived from said exhaust gas to heat areas of said surface which are not heated by said heating of said preliminary layer.

13. The method of claim 9 wherein said preliminary layer is formed to have a vertical thickness which is less than the effective depth of penetration of said microwave energy downwardly into said preliminary layer whereby the uppermost region of said surface beneath said preliminary layer is also heated directly by said microwave energy.

14. A paving materials processing vehicle for heating paving materials which are initially deposited in a windrow extending along a strip of surface to be paved, said vehicle having a vehicle body with ground engaging means enabling movement of said vehicle along said strip of surface, further comprising:

microwave energy applicator means for directing microwave energy downward into paving materials situated thereunder to heat said materials, including a microwave containment structure having a top wall and sidewalls and materials entrance and exit openings, said containment structure being positioned on said vehicle to receive said windrowed materials through said entrance opening as said vehicle travels along said surface, and further including microwave energy trapping means for blocking the escape of microwave energy in upward and outward directions, said microwave energy applicator means including said containment structure and said trapping means being carried on said vehicle, and windrow shaping means for forming said paving materials of said windrow into a preliminary layer of greater height and less width than the final layer of said paving materials to be formed on said strip of surface to be paved, said windrow shaping means being carried on said vehicle in position to intercept said windrow as said vehicle is traveled along said strip of surface and to cause said preliminary layer of paving materials to pass through said microwave containment structure of said microwave energy applicator means as said vehicle travels along said strip of surface.

15. The combination of claim 14 further comprising mixing means for mixing the paving materials of said preliminary layer, said mixing means being carried on said vehicle in position to stir said paving materials of said preliminary layer following initiation of said microwave heating thereof.

16. The combination of claim 15 wherein said vehicle carries a plurality of said microwave applicator means spaced apart in the direction of travel of said vehicle along said preliminary layer and wherein said vehicle also carries a plurality of said mixing means also spaced apart in said direction of travel of said vehicle along said preliminary layer, said microwave applicator means and said mixing means being alternated along said direction of travel.

17. The combination of claim 14 further comprising auxiliary heating means carried on said vehicle in position to heat areas of said strip of surface that are not heated as a result of passage of said microwave applicator means thereover.

18. The combination of claim 17 further comprising at least one fuel consuming motor carried on said vehicle for driving a generator which is electrically coupled to said microwave applicator means to supply electrical energy thereto for producing said microwave energy, and wherein said auxiliary heating means comprises means for transmitting thermal energy from the hot exhaust gases of said engine to said areas of said strip of surface.

19. The combination of claim 18 further comprising means disposed on said vehicle for transmitting a portion of said thermal energy from said hot exhaust gases to said preliminary layer of paving materials to supplement the microwave heating thereof.

20. The combination of claim 14 further comprising spreader means for distributing said preliminary layer of paving materials laterally to form said final layer of paving materials, said spreader means being supported on said vehicle behind said microwave energy applicator means in position to intercept and spread said preliminary layer of paving materials after passage of said microwave energy applicator means thereover.

21. The combination of claim 20 further comprising means for smoothing and compacting said final layer of paving materials while in the heated condition, said means for smoothing and compacting being supported on said vehicle in position to override said paving materials following passage of said spreader means thereover.

22. A paving materials processing vehicle for heating and mixing paving materials which are initially deposited in a windrow extending along a surface to be paved, comprising:

windrow shaping means for forming said paving materials into a preliminary layer of less width but greater vertical thickness than the final layer of paving materials to be formed on said surface, said shaping means being secured to said vehicle in position to form successive portions of said windrow into said preliminary layer as said vehicle is traveled along said surface, an inverted channel structure formed of electrically conductive material and secured to the underside of said vehicle behind said windrow shaping means in position to straddle and pass along said preliminary layer as said vehicle is traveled along said surface, said inverted channel structure having downwardly extending side walls spaced apart a distance corresponding to said width of said preliminary layer and having means for blocking the escape of microwave energy from the region between said side walls other than in a downward direction, at least one microwave energy source disposed on said vehicle and waveguide means for directing microwave energy from said source downwardly into said preliminary layer within said region between said side walls, means secured to said vehicle for directing hot gas into said region between said side walls to supplement the microwave heating of said paaving materials, and means secured to said vehicle for mixing the paving materials of said preliminary layer in place on said surface, said mixing means being disposed at the underside of said vehicle behind said means for directing microwave energy into said preliminary layer.

23. A paving materials processing vehicle as defined in claim 22 further comprising:

at least one electrical generator on said vehicle for energizing said microwave energy source, at least one fuel consuming motor on said vehicle, said motor being coupled to said generator to drive said generator, and means on said vehicle for using the thermal energy of the exhaust gases of said motor to heat areas of said surface situated laterally from said inverted channel structure as said vehicle is traveled along said surface.

24. A paving materials processing vehicle as defined in claim 22 further comprising a tank disposed on said vehicle for carrying a liquid pavement constituent, and means on said vehicle for releasing liquid pavement constituent from said tank into said preliminary layer as said vehicle is traveled therealong.

25. A paving materials processing vehicle as defined in claim 22 further comprising a receptacle disposed on said vehicle for carrying solid pavement constituent, and conveyor means on said vehicle for delivering said solid constituent from said receptacle to said preliminary layer as said vehicle is traveled therealong.

26. A paving materials processing vehicle as defined in claim 22 further comprising:

a rotary spreader auger extending transversely at the underside of said vehicle behind said mixing means and supported on said vehicle in position to intercept said preliminary layer as said vehicle is traveled along said surface and to carry materials of said preliminary layer laterally to form said final layer of greater width and lesser vertical thickness, and pavement compaction means for smoothing and compacting said final layer, said compaction means extending transversely at the underside of said vehicle behind said spreader auger and being supported on said vehicle in position to ride on the surface of said final layer as said vehicle is traveled along said surface.

27. A paving materials processing vehicle as defined in claim 22 wherein said vehicle carries electrically conductive members which extend along each side of said preliminary layer and along the top surface thereof at the front and rear regions of said inverted channel structure whereby the materials of said preliminary layer are utilized to absorb microwave energy which would otherwise escape from said channel structure in the forward and backward directions.

* * * * *